US011083309B2

(12) United States Patent
Hinnant

(10) Patent No.: US 11,083,309 B2
(45) Date of Patent: Aug. 10, 2021

(54) DUAL AIR CHAMBER STRUCTURE AND METHOD FOR USING

(71) Applicant: Edward Hinnant, Ellijay, GA (US)

(72) Inventor: Edward Hinnant, Ellijay, GA (US)

( * ) Notice: Subject to any disclaimer, the term of this patent is extended or adjusted under 35 U.S.C. 154(b) by 0 days.

(21) Appl. No.: 15/247,404

(22) Filed: Aug. 25, 2016

(65) Prior Publication Data

US 2017/0164760 A1 Jun. 15, 2017

Related U.S. Application Data

(60) Provisional application No. 62/267,136, filed on Dec. 14, 2015.

(51) Int. Cl.
*A47C 27/08* (2006.01)
*A47C 27/10* (2006.01)
*B63B 7/00* (2020.01)

(52) U.S. Cl.
CPC ..... *A47C 27/081* (2013.01); *A47C 27/10* (2013.01); *B63B 7/00* (2013.01)

(58) Field of Classification Search
None
See application file for complete search history.

(56) References Cited

U.S. PATENT DOCUMENTS 2,241,847 A * 5/1941 Eberhard ..... B60C 29/007 137/223
3,276,047 A 10/1966 Emery
3,705,429 A * 12/1972 Nail ..... A47C 27/10 5/710
5,113,539 A * 5/1992 Strell ..... A47C 23/047 297/284.3
5,598,593 A * 2/1997 Wolfe ..... A47C 27/081 5/710
5,640,731 A * 6/1997 Toedter ..... A47C 21/046 5/710
5,907,878 A * 6/1999 Thomas ..... A47C 27/082 5/710
5,960,495 A * 10/1999 Hsu ..... A47C 27/087 5/706
6,047,423 A * 4/2000 Larson ..... A47C 27/082 5/709
6,098,223 A * 8/2000 Larson ..... A47C 27/088 5/716

(Continued)

FOREIGN PATENT DOCUMENTS

GB 2082907 A * 3/1982 ..... A47C 27/088

*Primary Examiner* — Kevin M Bernatz
(74) *Attorney, Agent, or Firm* — Gronholm Patent Services

(57) ABSTRACT

A dual air chamber structure having two independent and air impervious chambers, with each chamber being inflated and deflated by a separate air valve. The inner chamber, except for its air valve, is completely contained by the outer chamber and is comprised of primary horizontal conduit and a plurality of inflatable intermittent vertical posts made of small diameter tubing which are connected by a corresponding plurality of horizontal conduit made of small diameter tubing, such that the inner chamber as a whole is comprised of a repeating series of inflatable vertical posts followed by inflatable horizontal connectors. The outer chamber forms an air impervious bladder around the inner chamber, except for the air valve of the inner chamber.

9 Claims, 6 Drawing Sheets

(56) References Cited

U.S. PATENT DOCUMENTS

| | | | | |
|---|---|---|---|---|
| 6,112,350 | A * | 9/2000 | Larson | A47C 21/06 5/710 |
| 6,212,719 | B1 | 4/2001 | Thomas et al. | |
| 6,446,289 | B1 | 9/2002 | Su | |
| 6,651,277 | B1 | 11/2003 | Marson | |
| 6,701,559 | B2 | 3/2004 | Boso | |
| 6,763,540 | B1 * | 7/2004 | Wang | A47C 27/081 5/706 |
| 7,120,950 | B2 | 10/2006 | Garrigues | |
| 7,181,795 | B2 * | 2/2007 | Wu | A47C 27/081 5/710 |
| 7,434,283 | B2 * | 10/2008 | Wilkinson | A47C 27/084 5/710 |
| 8,584,287 | B2 | 11/2013 | Hrubant | |
| 8,590,079 | B2 * | 11/2013 | Habegger | A61G 7/05769 5/655.3 |
| 9,271,579 | B2 * | 3/2016 | Riley | A47C 27/18 |
| 2009/0320211 | A1 * | 12/2009 | Lau | A47C 27/081 5/713 |
| 2011/0154574 | A1 * | 6/2011 | Hrubant | A47C 27/084 5/706 |
| 2013/0061399 | A1 * | 3/2013 | Dewell | A47C 27/08 5/713 |
| 2013/0331749 | A1 * | 12/2013 | Borden | A61H 9/0092 601/151 |
| 2013/0340164 | A1 | 12/2013 | Bresinger | |
| 2015/0209206 | A1 * | 7/2015 | Bargellini | A61G 5/1043 297/217.2 |
| 2016/0007763 | A1 | 1/2016 | Alder | |
| 2016/0128490 | A1 * | 5/2016 | Cheng | A47C 27/10 5/655.3 |

* cited by examiner

DUAL AIR CHAMBER STRUCTURE AND METHOD FOR USING

CROSS REFERENCES

This application claims the benefit of U.S. Provisional Application No. 62/267,136, filed Dec. 14, 2015. The provisional application identified above is incorporated by reference in its entirety to prove continuity of disclosure.

GOVERNMENT RIGHTS

None.

BACKGROUND OF THE INVENTION

Portable, inflatable devices are well known in the outdoor industry. A typical inflatable pad incorporates an air impervious bladder and a separate valve for inflating and deflating the bladder. One problem associated with typical inflatable pads is the time and air it takes to inflate them. In response, some inventors have chosen to develop self-inflating pads. These self-inflating pads may incorporate an air impervious bladder, similar to the inflatable pads, but utilize some object, such as open cell foam, that causes the bladder to expand without assistance by the user. The addition of the open cell foam increases the weight of the inflatable pad and increases the time for the pad to fully inflate. This same scope of problems can be seen throughout the outdoor inflatable industry. The current disclosure serves to remedy many of these problems.

BRIEF SUMMARY OF THE INVENTION

Disclosed is a dual air chamber structure having two independent and air impervious chambers, with each chamber being inflated and deflated by a separate valve. The (first) inner chamber, except for its air valve, is completely contained by the (second) outer chamber and is comprised of a plurality of inflatable intermittent vertical posts made of small diameter tubing which are connected by a corresponding plurality of inflatable horizontal connectors made of small diameter tubing, such that air is free to flow between the vertical and horizontal elements. The inner chamber as a whole is comprised of a repeating series of inflatable vertical posts followed by inflatable horizontal connectors.

The inner surface of the outer chamber may contact the top and bottom of each vertical post of the inner chamber, thereby sealing the top and bottom of each vertical post. As the inner chamber inflates, the vertical posts stand up, thereby providing a mechanism to force the sides of the outer chamber away from each other. This creates a vacuum in the outer chamber, which allows air to be drawn into the outer chamber's valve thereby inflating the outer chamber.

LISTING OF COMPONENTS

101—Inner Chamber
103—Inner Chamber Air Valve
104—Primary Horizontal Conduit
105—Vertical Post
105(*a*)—Top of Vertical Post
105(*b*)—Bottom of Vertical Post
107—Secondary Horizontal Conduit
109—Outer Chamber
111—Outer Chamber Air Valve
113—Outer Chamber Upper Layer
115—Outer Chamber Lower Layer
117—Outer Chamber Single Outer Layer
119—Outer Chamber Inner Surface

DETAILED DESCRIPTION OF THE INVENTION

Disclosed is a dual air chamber device having two independent and air impervious chambers.

Figure 1:
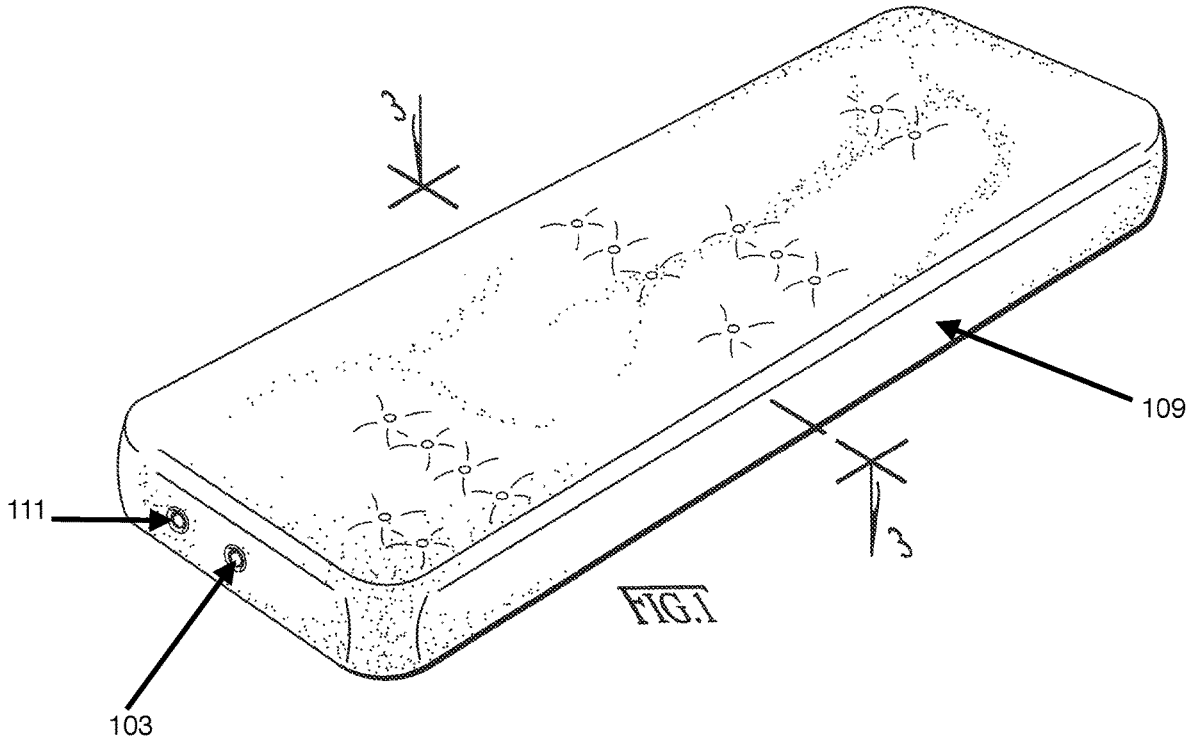
FIG. 1 is an external perspective view of the dual air chamber device.
Figure 2:
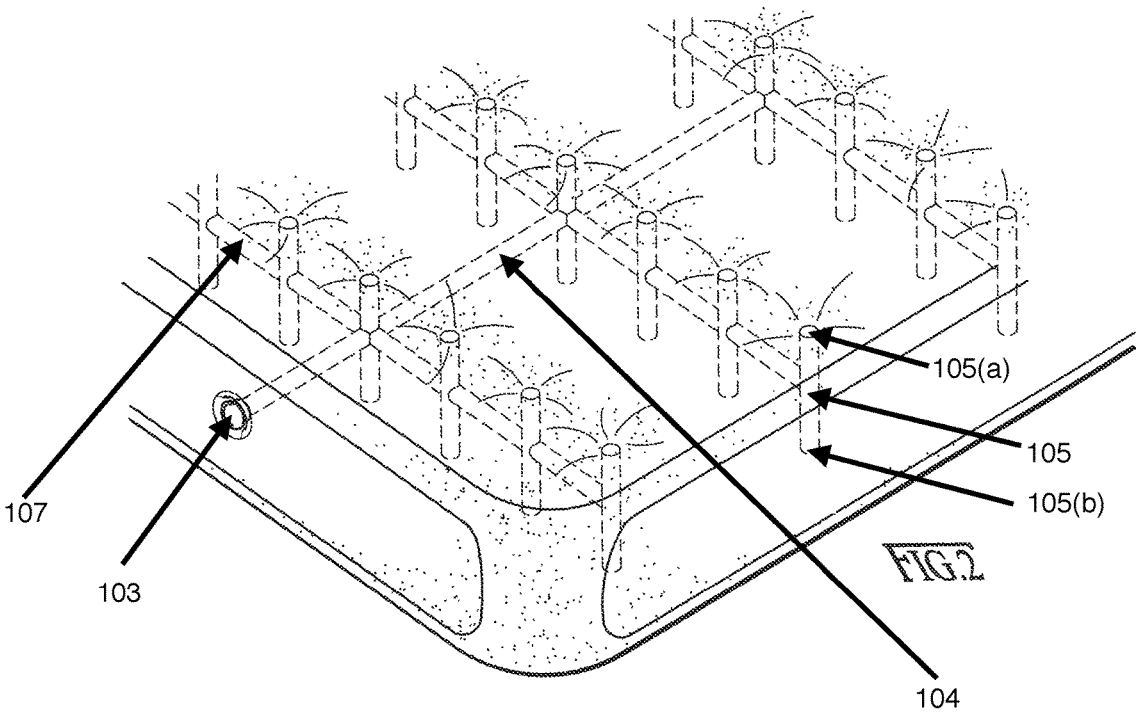
FIG. 2 is an internal perspective view of the dual air chamber device.
Figure 3:
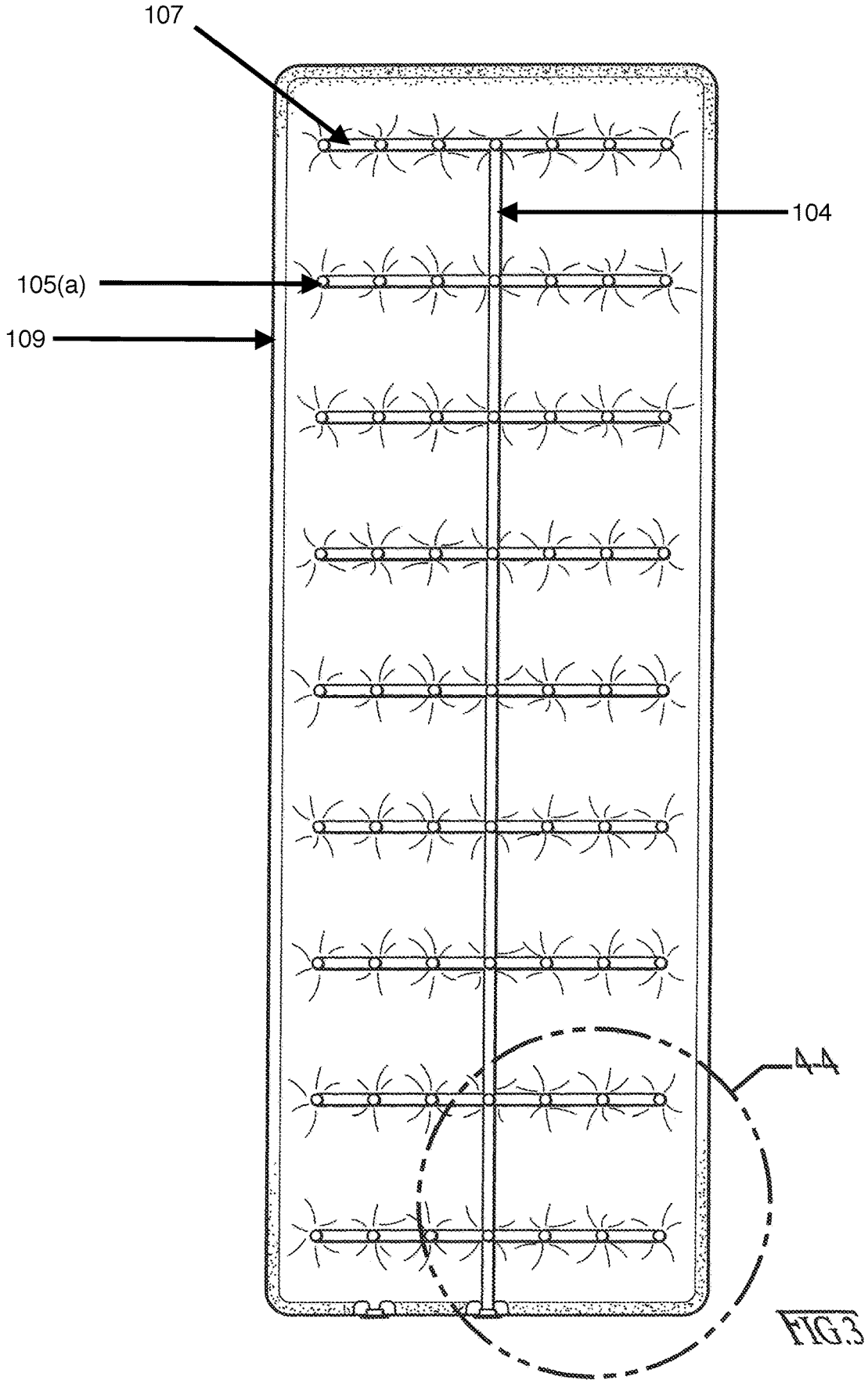
FIG. 3 is a top view of the dual air chamber device.
Figure 4:
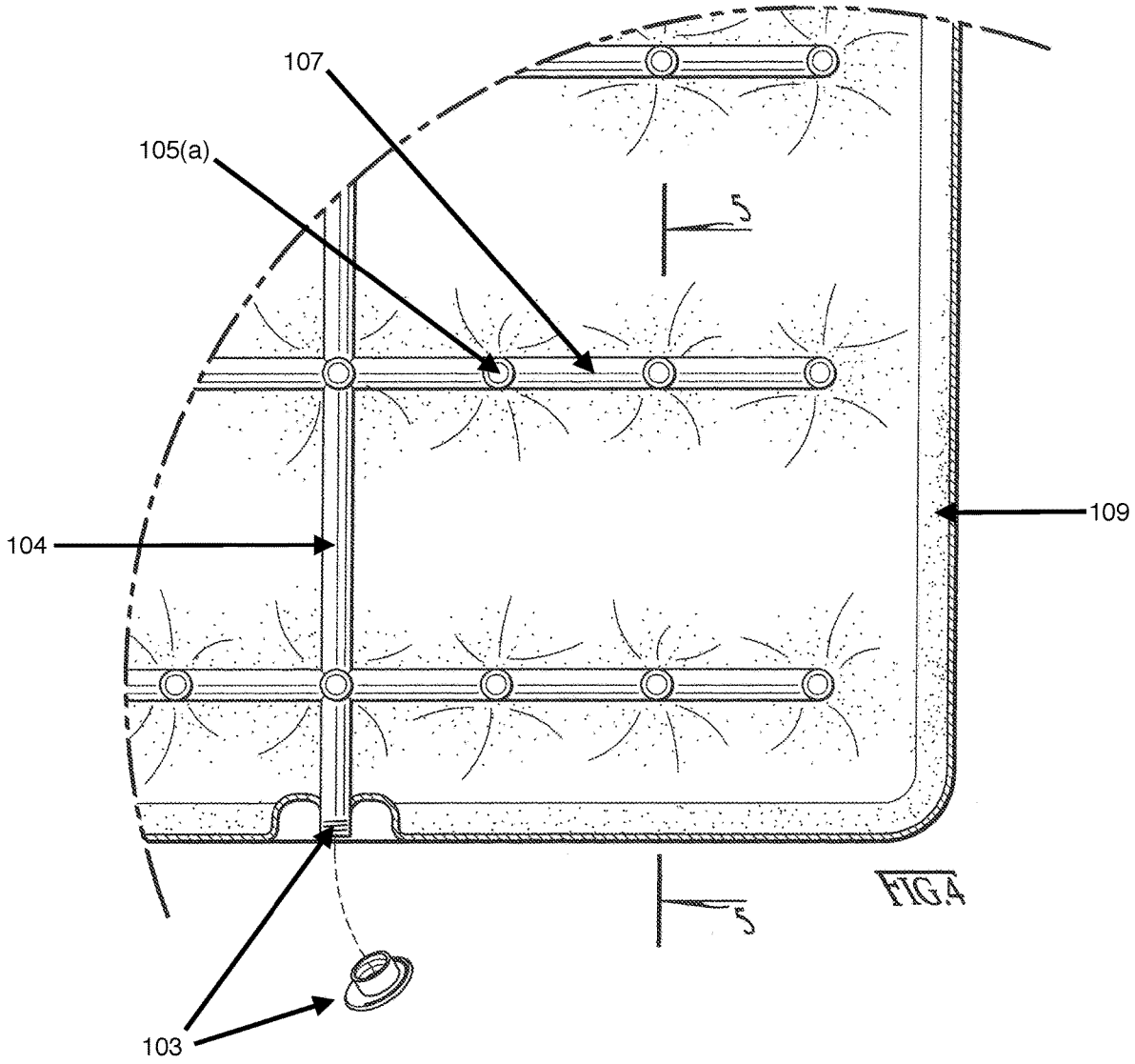
FIG. 4 is a detailed top view of the dual air chamber device.
Figure 5:
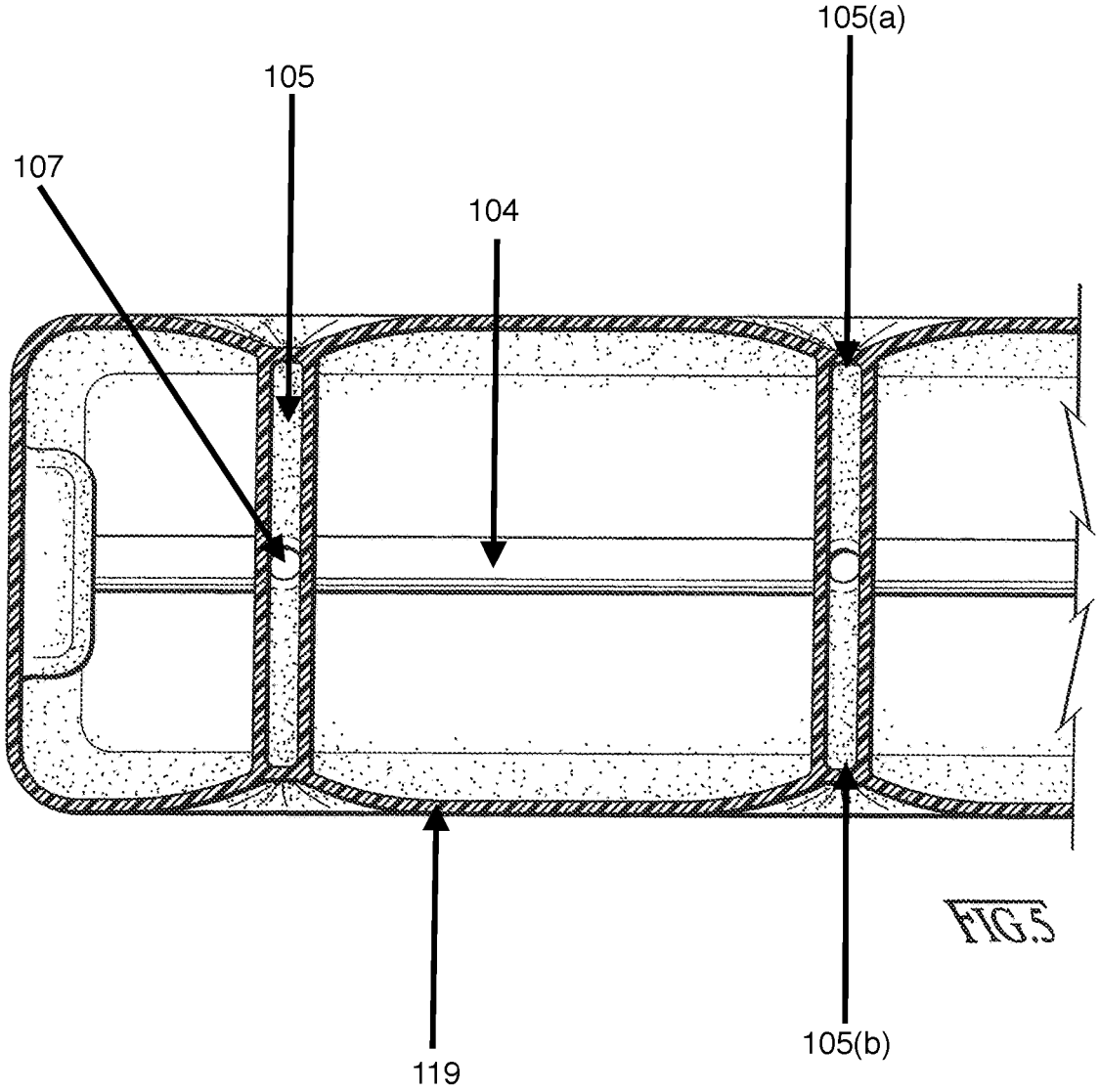
FIG. 5 is an internal side view of the dual air chamber device.

The inner chamber 101, except for its air valve 103, is completely contained by the outer chamber 109. The inner chamber 101 may be comprised of a primary horizontal conduit 104 and a plurality of inflatable intermittent vertical posts 105 made of small diameter tubing which are connected by a corresponding plurality of inflatable horizontal connectors 107 made of small diameter tubing, such that air is free to flow between the primary conduit 104, vertical posts 105, and secondary horizontal conduits 107. As shown in FIG. 2, the inner chamber 101 as a whole (101, 104, 105, 107) represents a continuous unit such that air may flow freely between the primary horizontal conduit 104, 107. The vertical posts 105 and horizontal conduits (104, 107) may be cylindrical in shape, although other shapes may be used. The angle between the vertical posts 105 and horizontal conduits (104, 107) may vary in alternative embodiments. The diameter and overall size, as well as the density of the vertical posts 105 and horizontal conduits (104, 107) may also vary depending on the particular application of the dual air chamber structure.

Figure 6:
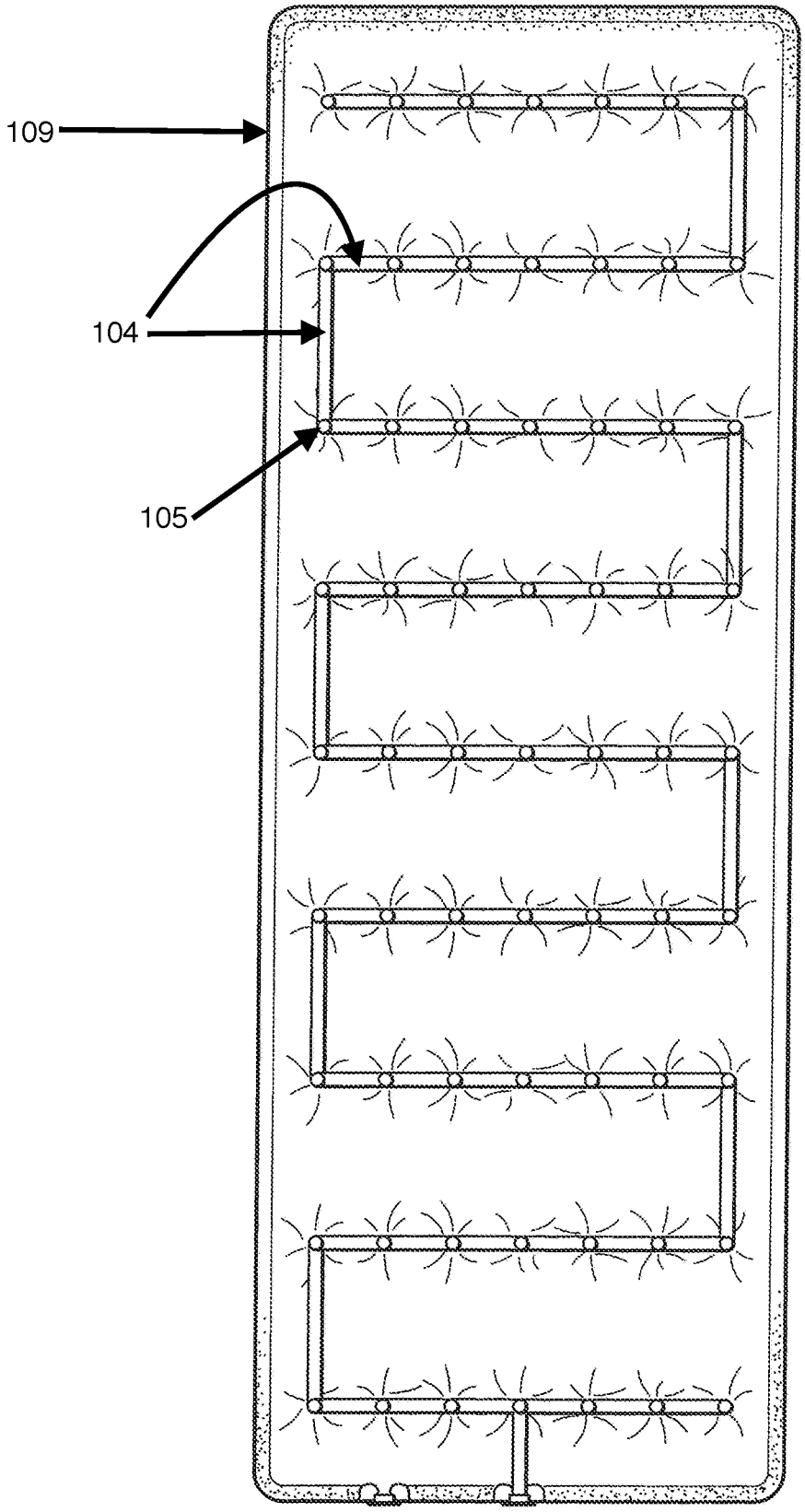
FIG. 6 is a top view of an alternate embodiment of the dual air chamber device.
Figure 7:
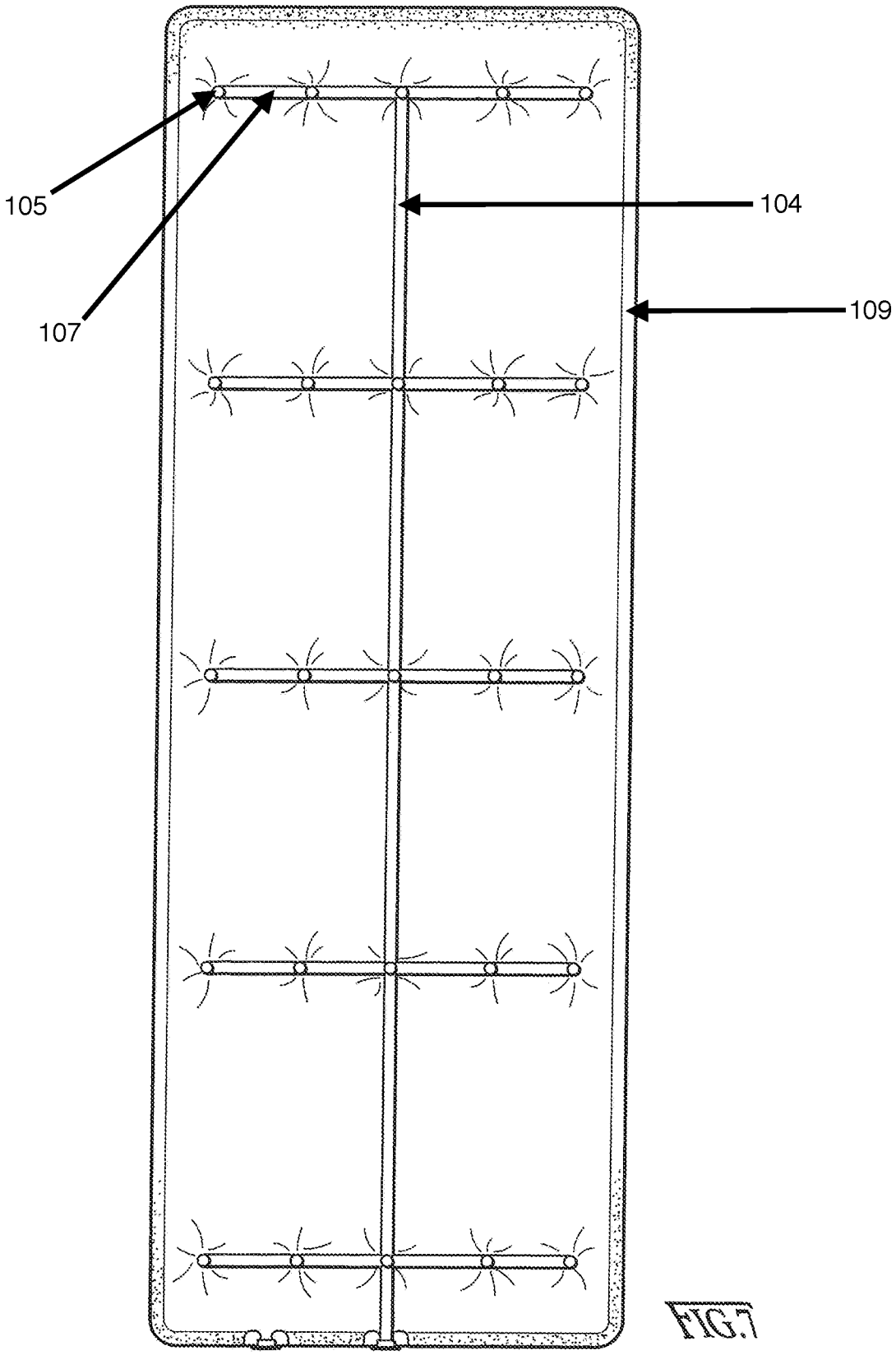
FIG. 7 is a top view of an alternate embodiment of the dual air chamber device.

In one preferred embodiment, as shown in FIG. 2, the inner chamber 101 may be comprised of a primary horizontal conduit 104 having a plurality of secondary horizontal conduits 107, each secondary horizontal conduit 107 having a plurality of intermittent vertical posts 105. In another preferred embodiment, as shown in FIG. 6, the inner chamber 101 may be comprised of a "snaking fence" structure, wherein a primary horizontal conduit 104 contains a plurality of intermittent vertical posts 105. In other preferred embodiments, the structure and or shape of the inner chamber 101 may vary such that each embodiment is defined by a primary and/or secondary horizontal conduits (104, 107) having a plurality of intermittent vertical posts 105.

The outer chamber 109 is comprised of an upper layer 113 and lower 115 layer, such that the two layers (113, 115) are fused together to form an air impervious bladder. In other preferred embodiments, the outer chamber may be comprised of a single outer layer, sealed to form an air impervious bladder. The outer chamber 109 contains an air valve 111.

In one preferred embodiment, the inner surface 119 of the outer chamber 109 contacts the top 105(*a*) and bottom 105(*b*) of each vertical post 105 of the inner chamber preferred embodiments, the vertical posts 105 of the inner chamber 101 may be sealed independently of the inner surface 119 of the outer chamber 109, such that although the top 105(*a*) and bottom 105(*b*) of each vertical post 105 may still come into contact with the inner surface 119 of the outer chamber 109, the inner surface 119 of the outer chamber 109 does not seal the top 105(*a*) or bottom 105(*b*) of the vertical posts 105.

In each preferred embodiment, as the inner chamber 101 inflates, the vertical posts 105 stand up (inflate), thereby providing a mechanism to force the inner surfaces 119 of the outer chamber 109 away from each other. This creates a vacuum effect in the outer chamber 109, which allows air to be drawn into the outer chamber's air valve 111 thereby inflating the outer chamber 109. This allows a user to quickly and easily inflate the dual air chamber structure, without relying on "self-inflating" means such as open cell foam.

The inner 101 and outer 109 chambers may be made of any material typical to the industry such as rip-stop nylon, polyester, or a polyurethane material. The air valves (103, 111) for each chamber (101, 109) may be of a type typical to the industry, such as a screw type valve.

To inflate the device, a user first opens both air valves (103, 111). As the user pushes air into the inner chamber 101, the vertical posts 105 inflate, thereby pushing the walls of the outer chamber 109 away from each other. This creates a vacuum effect in the outer chamber 109 causing air to be drawn through the outer chamber's air valve 111. When the inner chamber 101 is inflated to the user's preference, the user closes the inner A user may add additional air to the outer chamber 109 if desired. Finally, the user should close the outer chamber's air valve 111.

Those in the art will appreciate that the disclosed technology has a number of possible applications. For example, the inventor envisions the device being incorporated into lightweight sleeping pads and mattresses, other inflatable outdoor items such as kayaks and rafts, and other products with a need for such a technology.

I claim:

1. A dual air chamber device, comprising:

an inner chamber comprised of an air valve and an interconnected grid of inflatable tubing created by a primary horizontal conduit connected to a plurality of vertical spaced apart inflatable posts each having a top and a bottom end, wherein said inflatable tubing and said inflatable posts have substantially the same diameter upon inflation; and an outer chamber comprised of an air valve and an inner surface, wherein said outer chamber forms an air impervious bladder around said inner chamber, except for the air valve of the inner chamber, said outer chamber including an upper wall and a lower wall, said upper wall having said top ends of said spaced apart inflatable posts of said inner chamber in contact therewith, and said lower wall having said bottom ends of said spaced apart inflatable posts of said inner chamber in contact therewith, said inner and outer chambers interconnected such that introduction of air under pressure into said inner chamber causes said intermittent inflatable vertical posts to extend in height, such that said tops of said spaced apart inflatable posts push upwardly against said upper wall, and such that said bottoms of said spaced apart inflatable posts push downwardly against said lower wall, causing said upper wall to move upwardly away from said lower wall, such that a vacuum is provided, said vacuum being sufficient to cause air to be drawn into said outer chamber air valve when in its open position.

2. The dual air chamber device of claim 1, wherein said tops and bottoms of said plurality of said spaced apart inflatable posts are sealed by said inner surface of the outer chamber such that said inner chamber holds and contains air or fluid completely independent of said outer chamber.

3. The dual air chamber of device of claim 1, wherein said top and bottom of said plurality of said spaced apart inflatable posts are sealed independently of said inner surface of the outer chamber.

4. The dual air chamber device of claim 1, wherein said tops of said spaced apart inflatable posts are in contact with said upper wall at discretely spaced apart top contact locations located in a substantially horizontal first plane, wherein said bottoms of said spaced apart inflatable posts are in contact with said lower wall at discretely spaced apart bottom contact locations located in a substantially horizontal second plane, and wherein said spaced apart inflatable posts are elongate and include longitudinal axes which are substantially normal to said first and second horizontal planes.

5. The dual air chamber device of claim 4, wherein said interconnected inflatable posts form an inflatable post grid comprised of a plurality of inflatable post rows and a plurality of inflatable post columns, said columns being substantially perpendicular to said rows, and wherein said top contact locations and said bottom contact locations likewise form corresponding grids having rows and columns, all of which combine to provide upper and lower grids of spaced apart contact points which push up and down against said upper and lower walls, respectively, upon inflation of said inner bladder.

6. A dual air chamber device, comprising:

A) an outer chamber configured for selectively retaining a volume of air, said outer chamber itself comprising:

1) an outer chamber air valve configured to be either open or closed so as to allow or prevent airflow therethrough, respectively;

2) an upper wall; and 3) a lower wall, said upper and lower walls and said air valve configured to combine to at least partially provide a closed chamber configured to retain a volume of air when said outer chamber air valve is closed, B) an inner chamber configured for selectively retaining a volume of air, said inner chamber itself comprising:

1) an inner chamber air valve configured to be either open or closed so as to allow or prevent airflow therethrough, respectively;

2) a plurality of vertical elongate spaced apart inflatable posts, each of said inflatable posts having a pair of opposing ends being a top end and a bottom end, each of said pairs of opposing ends configured to increase in distance from a shorter distance to a longer distance when air is introduced into their particular post; and 3) an interconnected grid of inflatable tubing providing for air communication between said plurality of inflatable posts and said inner chamber air valve, wherein said inflatable tubing and said inflatable posts have substantially the same diameter upon inflation, said plurality of elongate spaced apart inflatable posts, said grid of inflatable tubing, and said air valve configured to combine to at least partially provide a closed chamber configured to retain a volume of air when said inner chamber air valve is closed, said upper wall of outer chamber said having said tops of said inflatable posts in contact therewith and said lower wall of outer chamber said having said bottoms of said inflatable posts in contact therewith, said inner and outer chamber being interconnected such that introduction of air under pressure into said inner chamber causes said inflatable posts to extend in length, such that said top ends of said vertical posts push upwardly against said upper wall, and such that said bottom ends of said vertical posts push downwardly against said lower wall, causing said upper wall to move upwardly away from said lower wall, such that a vacuum is provided within said outer chamber, said vacuum being sufficient to cause air to be drawn into said outer chamber air valve when in its open position.

7. A dual air chamber device, said device comprising:

A) an outer bladder including an upper and a lower wall, and also including a selectively closable outer bladder valve for allowing air in and out of said outer bladder; and B) an inner bladder itself comprised of a plurality of spaced apart inflatable posts, each of which has its top end in contact with said upper wall of the outer bladder, and each of which has its bottom end in contact with said lower wall of the outer bladder, said inner bladder also including a selectively closable inner bladder valve for allowing air in and out of said inner bladder, said inflatable posts forming a grid of interconnected inflatable posts comprised of a plurality of rows and a plurality of columns, said columns being substantially perpendicular to said rows, wherein the interconnected inflatable posts are connected via a grid of inflatable tubing, said inflatable tubing and said inflatable posts having substantially the same diameter upon inflation, said inner bladder valve independently operable relative to said outer bladder valve, such that said outer bladder valve can be left open while the inner bladder valve is open and said inner bladder is inflated, said inner and outer bladders relatively constructed such that said as said inner bladder is inflated, its inflatable posts combine to push apart the upper and lower walls of said outer bladder, and such that air tends to be drawn into the open valve in the outer bladder due to the presence of a relative vacuum within said inner bladder.

8. The dual air chamber device of claim 7, wherein said tops of said spaced apart inflatable posts are in contact with said upper wall at discretely spaced apart top contact locations located in a substantially horizontal first plane, wherein said bottoms of said spaced apart inflatable posts are in contact with said lower wall at discretely spaced apart bottom contact locations located in a substantially horizontal second plane, and wherein said spaced apart inflatable posts are elongate and include longitudinal axes which are substantially normal to said first and second horizontal planes.

9. The dual air chamber device of claim 8, wherein said interconnected inflatable posts form an inflatable post grid comprised of a plurality of inflatable post rows and a plurality of inflatable post columns, said columns being substantially perpendicular to said rows, and wherein said top contact locations and said bottom contact locations likewise form corresponding grids having rows and columns, all of which combine to provide upper and lower grids of spaced apart contact points which push up and down against said upper and lower walls, respectively, upon inflation of said inner bladder.

* * * * *